US005640812A

United States Patent [19]

Crowley et al.

[11] Patent Number: 5,640,812

[45] Date of Patent: Jun. 24, 1997

[54] ROOF PANEL DESIGN AND SINGLE BEAM ROOF ASSEMBLY

[75] Inventors: John S. Crowley, Portland, Me.; Michel R. Parent, Versailles, France; Leonard J. Morse-Fortier, Lexington, Mass.; Jordan L. Dentz, New York, N.Y.; Andre Sharon, Newton; Vikas Sharma, Cambridge, both of Mass.

[73] Assignee: Massachusetts Institute of Technology, Cambridge, Mass.

[21] Appl. No.: 342,140

[22] Filed: Nov. 18, 1994

Related U.S. Application Data

[62] Division of Ser. No. 712,202, Jun. 7, 1991, Pat. No. 5,365,705.

[51] Int. Cl.[6] ..... E04B 7/02

[52] U.S. Cl. ..... 52/90.1; 52/643

[58] Field of Search ..... 52/90.1, 586.1, 52/588.1, 405.2, 405.4, 407.5, 404.4, 302.1, 772, 474, 762, 764, 775, 302.3, 302.5, 302.7

[56] References Cited

U.S. PATENT DOCUMENTS

| | | | |
|---|---|---|---|
| 2,129,441 | 9/1938 | Otto | 52/474 X |
| 3,512,819 | 5/1970 | Morgan et al. | 52/586.1 X |
| 3,683,569 | 8/1972 | Holm | 52/764 X |
| 3,886,706 | 6/1975 | Baker | 52/474 X |
| 3,925,938 | 12/1975 | Molen | 52/90.1 X |
| 4,047,355 | 9/1977 | Knorr | 52/302.3 X |

*Primary Examiner*—Creighton Smith
*Attorney, Agent, or Firm*—Wolf, Greenfield & Sacks, P.C.

[57] ABSTRACT

The roof assembly for a structure including a number of support elements including walls, columns and beams includes a plurality of complementary shaped roof panels which are selectively secured to each other as well as a support beam and the support elements of the structure. Also disclosed are standard designs for the support beam and roof panels which have modifyable perameters as well as methods of designing the roof assembly, assembling the roof and its constituate components, and manufacturing the roof panels.

16 Claims, 7 Drawing Sheets

ROOF PANEL DESIGN AND SINGLE BEAM ROOF ASSEMBLY

This application is a divisional of application Ser. No. 07/712,202, filed Jun. 7, 1991, now U.S. Pat. No. 5,365,705.

FIELD OF THE INVENTION

The present invention relates to the field of building and construction technology, and more specifically, to engineered roof products for housing construction. The present invention provides a roof assembly which may be efficiently manufactured and assembled to customized specifications.

BACKGROUND OF THE INVENTION

The idea of the industrialized house, i.e., a house which is pre-cut or pre-assembled into kits, panels or modules delivered to the construction site, was first introduced over a century ago. However, industrialized house production in the United States counted for only 12% of annual house production in the United States on a national basis in 1986. One reason for the slow progress of this technology is that the advantages of pre-assembled kits or modules do not always offset the cost of factory assets, operations, transportion of the kits or modules to the construction site.

A more reasonable approach is to bring to the job site the materials or components which are engineered with a higher degree of sophistication to reduce the time and cost of assembly. This approach is in accord with the evolution of the building industry which started with primitive logs and stones before moving to standard sized lumber and building blocks. Next, products such as plywood and Sheetrock appeared followed by pre-assembled components such as pre-hung doors, windows, staircases, cabinets, fireplaces, roof trusses, etc. These products are part of an ongoing trend in the construction industry to reduce labor costs and minimize construction delays while maintaining design flexibility.

In constructing a new house, a significant portion of the costs are associated with the framing of the house and also the internal and external finishing of the various surfaces. In particular, a moderately complex roof design implemented with the conventional rafter or truss technology involves the complex assembly of a large number of components, many of which must be cut and trimmed on the job site. The application of an external covering to the roof, typically with asphalt shingles, is very labor intensive. In addition, conventional rafter or truss roof designs do not always provide satisfactory thermal performance, (i.e., ventilation, thermal bridging, etc.), or optimum utilization of the building volume.

Accordingly, there exists a need for a roof assembly comprising a plurality of components which can be engineered and manufactured according to the design and specification of the structure, which could be erected in a matter of hours after arrival at the job site.

It is therefore an object of the present invention to provide a roof assembly which may be manufactured and assembled with costs and in less time than conventional rafter or truss roof designs.

Another object of the present invention is to provide a roof assembly which will have good thermal performance, and which utilizes the building volume efficiently.

A further object of the present invention is to provide a roof assembly in which the individual components can be custom manufactured to the specification for the roof.

Another object of the present invention is to provide a roof panel having a standard design with modifiable parameter which may be custom manufactured to the design specifications of the roof.

A further object of the present invention is to provide a support beam having a standard design with modifiable parameters which can be custom manufactured to the design specifications of the roof.

Yet another object of the present invention is to provide a method of assembling a roof from a plurality which are customer manufactured to the design specification of the roof.

A further object of the present invention is to provide a method of manufacturing the roof panels of a roof assembly in accordance with the design specification of the roof.

BRIEF SUMMARY OF THE INVENTION

The foregoing and other objects of the present invention are achieved with the roof panel comprising first and second sheets disposed substantially parallel to each other along a first plane. A plurality of primary ribs, attached to the sheets extend along a second plane normal to the first plane and define at least one cavity between the sheets in which insulation is disposed. Means are provided for coupling the first sheet to an exterior surface.

According to a second embodiment of the present invention a method for manufacturing a roof panel comprises the steps of cutting first and second sheets into pre-determined shapes, providing a plurality of ribs perpendicular to the first sheet to define at lease one cavity therewith, depositing insulation into the cavity, and attaching the second sheet to the ribs so that the first and second sheets are substantially parallel.

According to a third aspect of the present invention, a support element for a roof comprises an elongate, three-sided beam having a substantially hollow interior and a triangular cross-section. The means are disposed within the interior of the beam for outwardly supporting the three sides of the beam. Two sides of the beam further include means for coupling the beam to the roof of a structure.

A roof assembly in accordance with the fourth aspect of the present invention comprises an elongate, three-sided beam partially disposed on the walls of a structure, and a plurality of roof panels, each having a pre-defined, complementary shape. Each of the roof panels is secured to at least one other roof panel. The roof assembly further comprises a plurality of spline elements disposed intermediate adjacent roof panels, a means for coupling selected of the roof panels to the walls of the structure.

A method of assembling a roof according to a fifth aspect of the present invention comprises the steps of providing an elongate, three-sided beam; providing a plurality of roof panels each having a pre-defined, complementary shape; supporting the elongate beam with the structure; securing selected roof panels to the beam, securing adjacent roof panels to one another; and securing selected roof panels to the walls of the structure.

A method for customized design of a roof assembly according to a sixth embodiment of the present invention comprises the steps of providing a specification for the roof, generating computer-aided design data describing the roof and structure, performing a structural analysis on the design data, selectively modifying the design data to conform with the specification, generating numerical control data used to manufacture the roof components, manufacturing the roof components in accordance with the numerical control data.

The invention will be more fully understood from the detailed description set forth below, which should be read in conjunction with the accompanying drawings. The invention is defined in the claims appended at the end of the detailed description, which is offered by way of example only.

DETAILED DESCRIPTION

The present invention discloses an innovative roof assembly including a triangular ridge beam which is supported by the internal and/or external walls of a structure, and, which in turn supports a plurality of roof panels secured to the ridge beam. Also disclosed are means for joining adjacent roof panels as well as means for joining the roof panels to the walls of the structure. In addition, a method is disclosed for custom designing and manufacturing the above-described roof assembly using computer aided design data. The following description of the various aspects of the present invention has been segmented into sub-headings to assist the reader.

Roof Panel Design

Figure 1B:
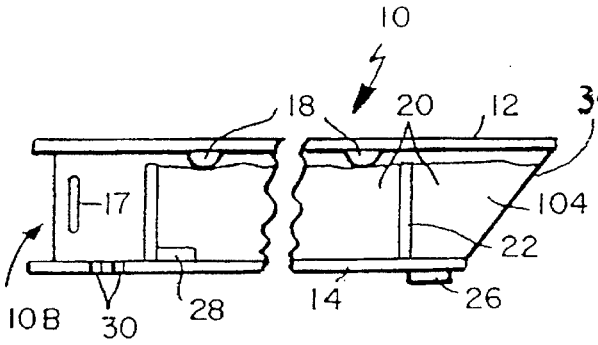
FIG. 1B is a side fragmented view of the roof panel of FIG. 1A.
Figure 1A:
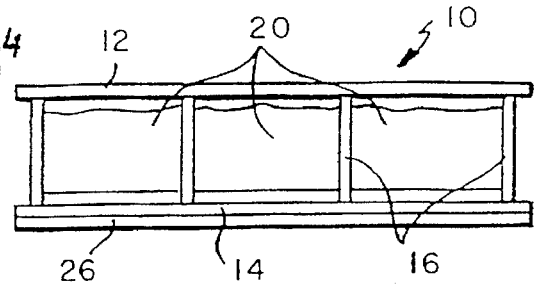
FIG. 1A is a front view of a roof panel in accordance with the present invention.
Figure 1C:
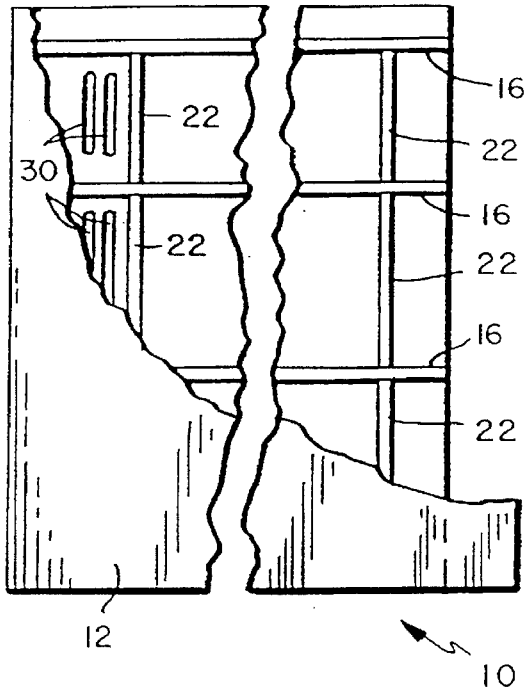
FIG. 1C is a top, fragmented, cutaway view of the roof panel of FIG. 1A.

Referring to the drawings, and in particular to FIGS. 1A–1C, a roof panel 10, in accordance with a first aspect of the present invention, is illustrated. Panel 10 comprises a top sheet 12, bottom sheet 14, primary ribs 16, secondary ribs 22, insulation 20, attachment ledge 26, reinforcement strip 28, and vent holes 30.

In the illustive embodiment, top sheet 12 and bottom sheet 14 are rectangularly shaped with a width approximately 4 feet and a length of up to approximately 30 feet. However, as explained hereinafter with reference to a method for manufacturing roof panels, the width, length and shape of the sheets may be varied according to design specifications as well as manufacturing limitations. Top sheet 12 and bottom sheet 14 comprise oriented strand board (OSB) approximately 7/16" thick. Alternately, sheets 12 and 14 may comprise gypsum fiberboard or other board having similar mechanical properties having a similar thickness. Sheets 12 and 14 are disposed parallel to one another and have at least two edges of their respective perimeters aligned in a vertical plane. Typically, the length of bottom sheet 14 is less than that of top sheet 14 to create a bevel at end 10A of roof panel 10, as explained hereinafter.

A plurality of primary ribs 16 are secured normal to the interior surfaces of sheets 12 and 14. As shown in FIGS. 1A–1C, ribs 16 interconnect top sheet 12 and bottom sheet 14 and define a plurality of open cavities therebetween. Primary ribs 16 have a height of approximately 9" and extend lengthwise across sheets 12 and 14. In the illustrative embodiment, primary ribs 16 are spaced approximately 15" from each other. The outermost ribs are inset from the edge of sheets 12 and 14 by approximately 1½. Primary ribs 16 have the same thickness and are formed of the same material as sheets 12 and 14. Ribs 16 may be secured to sheets 12 and 14 using an adhesive such as phenol-resorcinol-formaldehyde, hereafter referred to as PRF adhesive. Alternately, ribs 16 may be secured to sheets 12 and 14 with coil nails or wood gussets fastened with staples and/or adhesive. A plurality of semi-circular vent holes 18 extend through rib 16 along their top edge adjacent the interior surface of top sheet 12. It will be obvious to those obviously skilled in the art that vent holes 18 may be implemented in a variety of shapes and configurations. Alternately, ribs 16 may be formed from a pourous or semi-pourous material which has the ability to pass air there through without the need for specific apertures.

The end of each rib 16 contains a slit 17 positioned perpendicular to the longitudinal axis of the rib. Slit 17 is approximately 1" wide and is adapted to receive a strap of a typically 1" webbed nylon strap or other attachment used to lift roof panel 10 into place. The slits 17 allow multiple straps to be attached to the panel to achieve the proper angle upon hoisting and positioning of the panel.

A plurality of secondary ribs 22 extend transversely between ribs 16 and are secured normal to the interior surface of the bottom sheet 14. Secondary ribs 22 have a composition and thickness to similar primary ribs 16 but are approximately one inch shorter. Secondary ribs 22 may be secured to bottom sheet 14 and primary ribs 16 with the PRF adhesive. Secondary ribs 22 provide lateral support for primary ribs 16 and further define a plurality of cavities between top sheet 12 and 14.

Insulation 20 is disposed intermediate sheets 12 and 14 in the cavities defined by ribs 16 and 22. Insulation 20 extends from the interior surface of bottom sheet 14 to the top edge of ribs 22, thereby providing an air gap of approximately 1" adjacent the interior surface of top sheet 12. In the illustrative embodiment, insulation 20 may be loose fiberglass mixed with a bonding agent or may be a fiberglass batt insulation. Alternately, insulation 20 may comprise a foam insulation. The type and amount of insulation 20 may vary to accommodate different thermal and acoustic specifications for a given panel thickness. The R value of the insulation as well as its ability to attenuate sound will vary, depending on the climate and location of the structure. It will be obvious to those reasonably skilled in the art that in warm climates less insulation will be needed. In certain climates, air may serve as an adequate insulator within the cavities of the roof panel 10.

Vent holes 30 extend through bottom sheet 14 of roof panel 10 to provide ventilation to panel 10. Vent holes 30 are implemented as pairs of parallel slits disposed perpendicularly between pairs of primary ribs 16. Vent holes 30 extend through bottom sheet 14 and are covered with a mesh or screen which prevent debris including bugs and insects from entering the vent holes 30.

Cross-ventilation of air gap 24 between the cavities of roof panel 10 and between adjacent panels is provided via vent holes 30 of primary rib 16. Such ventilation cools top sheet 12 in the summer and prevents moisture accumulation within the panel and ice dams on the panel eaves in the winter.

A reinforcement strip 28 is secured adjacent the interior surface of bottom sheet 14 and next to the outermost secondary rib 22 at the non-vaulted end of panel 10. Refinforcement strip 28 typically comprises a 1"×6" plank of wood or wood composite material such as OSB. Reinforcement strip 28 facilitates attachment of roof panel 10 to the wall of a structure and serves to anchor attachment screws, as explained hereinafter. An attachment ledge 26 of similar size and composition is secured to the exterior surface of bottom sheet 14 near the beveled end 34 of roof panel 10 and facilitates attachment of the panel to the ridge beam support element, as explained hereinafter. Beveled end 34 of roof panel 10 is cut at an angle which depends on the style of the roof, the pitch of the roof and the particular location of the panel in the overall roof assembly.

The exterior surface of top sheet 12 may be covered with a weatherproof coating or a final roofing material, such as an asphalt/polymer product or a metal surface. The exterior surface of bottom sheet 14, which will function as the ceiling of the structure, may be coated with a primer laminated paper or polymer film, with the final decorative coat being applied in the field to maintain design flexibility. Alternately, value added materials such as wood veneers may be secured to the exterior surface of the bottom sheet 14, if designed, during the manufacturing process.

It will be obvious to those reasonably skilled in the art that the overall thickness, length, width and shape of roof panel 10 may vary according to structural requirements of the roof specification. Likewise, the number and configuration of ribs 16 and 22 may vary, provided adequate support is provided for sheets 12 and 14. Further, the illustrative roof panel 10 may be modified to receive skylights, roof windows, or even thermal or electric solar panels without deviating substantially from the disclosed implementation.

Figure 2A:
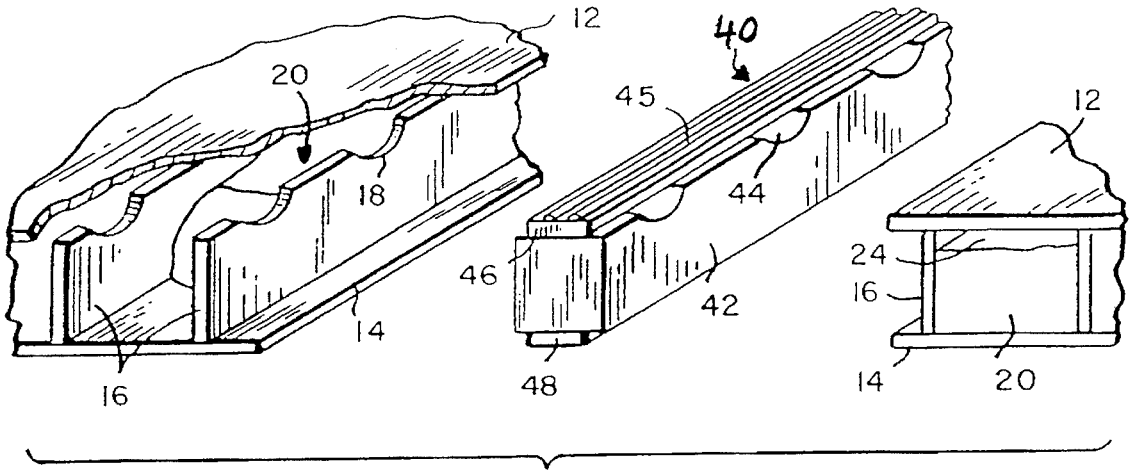
FIG. 2A is an exploded, perspective view of a pair of roof panels and a spline connecting element for joining them in accordance with the present invention.
Figure 2:
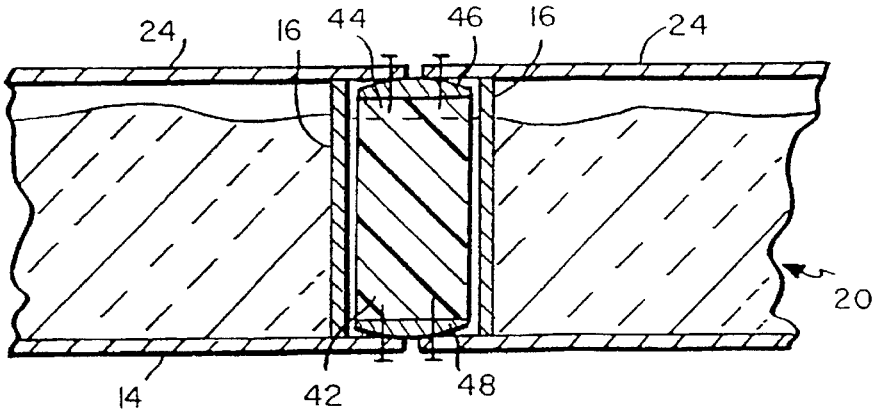
FIG. 2B is a front view of the elements of FIG. 2A showing them inter-connected.

Referring to FIGS. 2A–B, a spline 40 used to connect adjacent roof panels, is shown in relation to a pair of roof panels 10, as described above. In accordance with the present invention, spline 40 comprises a foam core 42, vent holes 44, foam gussets 45, top face 46 and bottom face 48. Foam core 42 comprises a rectangular beam of foam such as expanded polystyrene (EPS) foam, which has a plurality of vent holes 44 formed along the top surface thereof. The size and arrangement of vent holes 44 is similar to that of vent holes 30 of primary rib 16. Top face 46 and bottom face 48 are secured to the top and bottom surfaces of foam core 42, respectively, and are each formed of OSB or similar material approximately 7/16" in thickness. The foam gusset as gussets 45 are attached to top face 46 of spline 40. Gussets 44 comprise PVC foam sealant which surrounds the seam formed by the top sheets 12 of two adjacent roof panels 12, sealing the seal against water, air and sound. Such a foam gusset suitable for use in the present invention is manufactured under the name Norseal from Norton Performance Plastics, Granvill, N.Y. 12832.

As shown in FIG. 2B, when two roof panels 10 are positioned adjacent one another, their respective top and bottom sheets and outermost ribs form a rectangular cavity into which spline 40 is inserted. When in position, top face 46 of spline 40 bridges the gap between the edges of the adjacent top sheets 12. Fasteners, typically staples, nails or screws, are driven into each edge of the adjacent top sheets 12 and top face 46 of spline 40. In a similar manner, the edges of the adjacent bottom sheets 14 are secured to bottom face 48 of spline 40. When properly positioned, vent holes 44 of spline 40 are aligned with vent holes 30 of panels 10 to provide fluid communication between the air gaps 24 of the adjacent roof panels 10, thereby facilitating a cross-ventilation between adjacent roof panels.

In an alternate embodiment, spline 40, and particularly foam core 42, is compressed by a string or cord wrapped tightly about the perimeter of spline 40. Following insertion of spline 40 intermediate adjacent roof panels, the string is cut and the foam core expands to substantially fill the space between the adjacent roof panels. This embodiment simplifies the insertion of spline 40 prior to its fastening, given the close tolerances with which it and the roof panels are manufactured.

It may be appreciated that spline 40 provides a means for securing adjacent roof panels which is both water tight and provides a degree of acoustic and thermal insulation, while permitting cross-ventilation between adjacent roof panels.

Ridge Beam Design

Figure 3A:
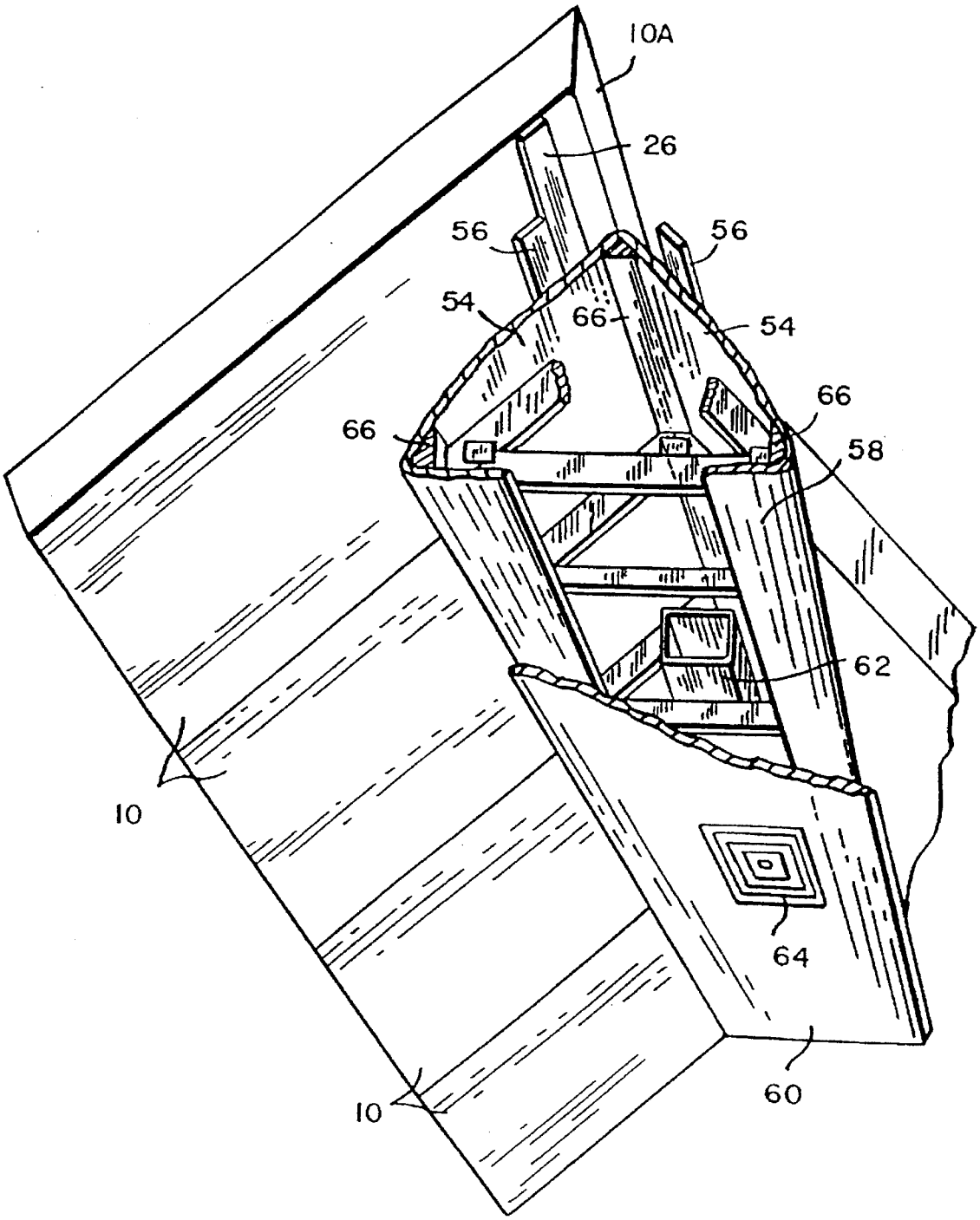
FIG. 3A is perspective, cutaway view of a ridge beam in accordance with the present invention.
Figure 3B:
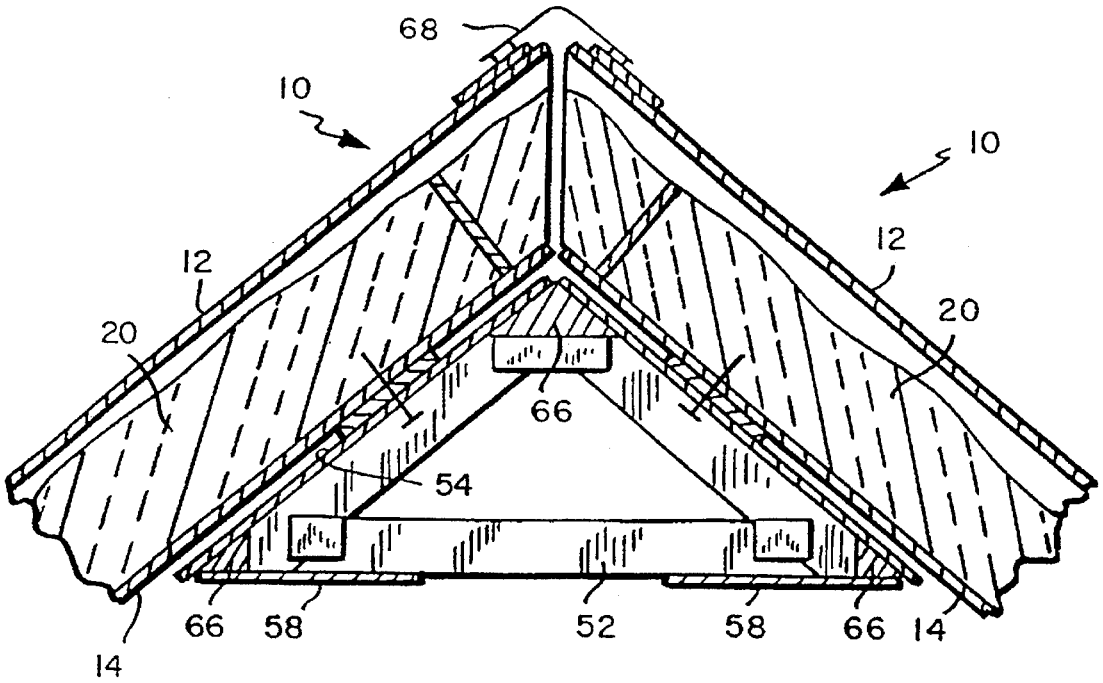
FIG. 3B is a front, partial, diagrammatic view of a pair of roof panels attached to the ridge beam of FIG. 3A.

Referring to FIGS. 3A–B, a ridge beam 50 in accordance with a second aspect of the present invention is illustrated. Ridge beam 50 serves as both the support element for the roof panels and as a guide during assembly of the roof. Ridge beam 50 comprises trusses 52, side sheets 54, support ledges 56, bottom sheets 58, and reinforcement members 66.

A plurality of triangular trusses 52 collectively form the skeletal structure of ridge beam 50. Each truss 52 is formed of three wood beams, typically 2"×4", cut and fastened together with metal fasteners to form a triangular shape having base angles similar to the angle or pitch of the roof. The corners of truss 52 are flat to accommodate reinforcement member 66, as explained hereinafter. The non-base sides of trusses 52 typically have a length of less than 5 feet. Trusses 52 are axially aligned and spaced at pre-determined intervals, typically 12", to form the skeletal structure of ridge beam 50.

A pair of side sheets 54, having double the thickness and composition as sheets 12 and 14, are secured to each truss 52 with PRF adhesive. Sheets 54 are usually rectangular in shape and have a width equal to the sides of trusses 52 and a length equal to that of ridge beam 50. A support ledge 56, typically a 1"×6" wood plank, is secured to each side sheet 54 and extends the length of ridge beam 50. Support ledges 56 are disposed symmetrically about the apex of ridge beam 50, as illustrated, and serve as both a means for supporting and guiding roof panels 10, as explained hereinafter. In an alternate embodiment, ridge beam 15 may have a pair of support ledges 56 on each side sheet 54 to further facilitate attachment of roof panel 10 to ridge beam 50.

A pair of bottom sheets 58 similar in length, thickness and composition to side sheets 54 are secured to trusses 52 along the base corners thereof. Bottom sheets 58 have a width of approximately 4 feet and are separated by a gap. This gap extends along the bottom of ridge beam 50 and provides access to the interior thereof to facilitate coupling of the ridge beam to the roof panels and to allow access to any interior elements of the ridge beam, as explained hereinafter.

Reinforcement members 66 are disposed in the triangular voids at the corners of ridge beam 50 and extend the length of ridge beam 50. Reinforcement member 66 comprise an engineered, composite wood material having a triangular cross-section. In the illustrative embodiment, reinforcement members 66 may be formed from Paralaem TM manufactured by MacMillan Bloedel Corporation of Vancouver, Canada. Alternately, reinforcement members 66 may be formed from Microlam manufactured by Trusjoist of Boise, Id. Other glue laminate or laminated veneer lumbers may be suitable for use as reinforcement members 66 which serve primarily to reinforce ridge beam 50 along its corners.

A cieling 60, not part of ridge beam 50, has a similar thickness and composition as side sheets 54, and is secured to bottom sheets 58. Ceiling 60 extends the length of ridge beam 50. Ceiling 60 serves as the interior ceiling of the structure and may have an appropriate decorative coating applied thereto. Ceiling 60 is secured to bottom sheets 58 only after roof panels 10 are secured to ridge beam 50 and any electrical, ventilation or lighting fixtures are placed within the interior of ridge beam 50, as explained hereinafter.

As indicated in FIG. 3A, a ventilation conduit 64 extends through ridge beam 50 and communicates with the interior of the structure through a vent 64 extending through ceiling 60. In the contemplated embodiments, electrical wiring as well as lighting fixtures may also be disposed within the interior or ridge beam 50 and extend through ceiling 60, where appropriate. In this manner, ridge beam 50 serves not only as the means for supporting the roof panels 10, but efficiently utilizes the building volume i.e. optimum cathedral ceiling, by accommodating electrical, ventilation and lighting apparatus therein.

The ends of ridge beam 50 are closed with a triangular piece of OSB and may be cut at a right angle to the axis of the ridge beam, to accommodate a gable wall, or at an angle, to accommodate a hipped roof, as explained hereinafter.

It will be obvious to those reasonably skilled in the art that the length and side angles of ridge beam 50 may vary according to the design specifications of the roof. In addition, the configuration of ridge beam 50 may also vary to accommodate various roof designs. Further, the configuration of bottom sheet 60 is dependent on the apparatus or devices which are disposed within the interior of ridge beam 50.

Roof Assembly and Construction

Figure 4A:
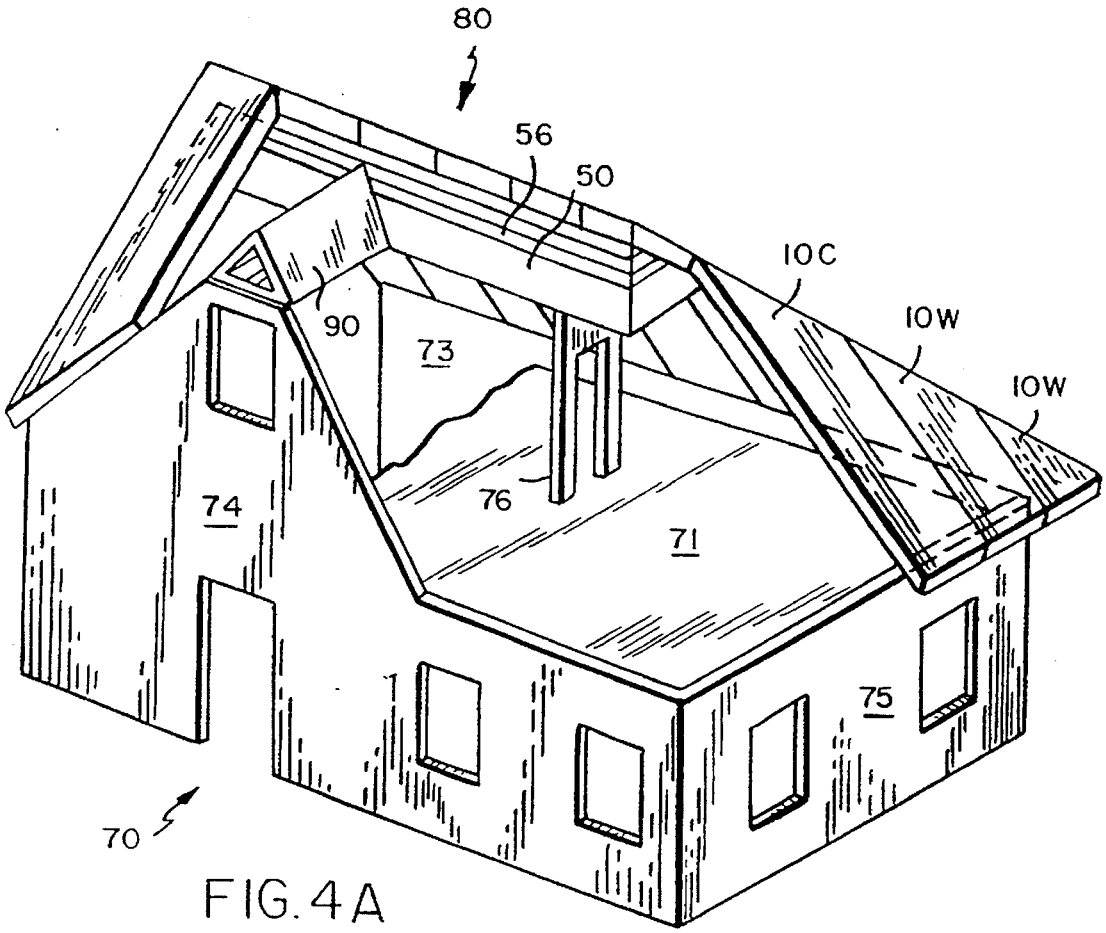
FIG. 4A is a cutaway perspective view of an exemplary roof assembly in accordance with the present invention showing the relationship between the support elements of a structure, the ridge beam and the roof panels.

Referring to FIGS. 3B, 4A-A-B and 5, an exemplary roof assembly 80 in accordance with a third aspect of the present invention, is illustrated. Roof assembly 80 comprises roof panels 10, ridge beams 50 and 90, ridge vent 68, splines 40, top plate 92 and a plurality of fasteners, typically staples, nails or screws of various sizes. Roof assembly 80 is attached to the walls of house 70, as shown in FIG. 4A.

House 70 comprises a variety of support elements including a main gable wall 72, and wall 73, side wall 75, ceiling 71 and columns 76. Walls 72–75 may be formed from 2"×4" studs covered by OSB sheething or may be formed in any conventional manner. The construction of the walls of house 70 is not critical to the proper implementation of roof assembly 80. As shown in FIG. 4A, main gable wall 72 and side gable wall 74 have substantially flat top surfaces, as does column 76 to accommodate ridge beam 50.

As illustrated in FIG. 4A, ridge beam 50 rests on the top surfaces of main gable walls 72 and 74 and column 76. A side ridge beam 90 is coupled with ridge beam 50 in a manner explained hereinafter, and rests adjacent the top surface of side gable wall 74. Ridge beams 50 and 90 are the only support structure for roof assembly 80. In practice, depending on the house design, the ridge beam is supported by a combination of gable ends, partition walls, and beam or column supports. A typical ridge beam can span up to approximately 30 feet. Further, the ridge beam may be implemented in a canterlevered configuration, while still providing adequate support for the roof panels.

In the illustrative embodiment, the end of ridge beam 50 is cut at the same angle as the hip section of roof assembly 80, as explained hereinafter. Typically, ridge beam 50 is placed on top of walls 72 and column 76 with a crane. Side ridge beam 90 is then placed on side gable wall 74 and secured to ridge beam 50. The joining end of side ridge beam 90 is cut at an angle and is partially covered with a triangular piece of OSB. An attachment ledge (not shown), similar to ledge 26 is placed adjacent support ledge 56 of ridge beam 50. Support ledge 56 provides a means for both supporting ridge beam 90 and guiding ridge beam 90 into proper alignment. One or more wood screws or staples are driven through the attachment ledge on ridge beam 90 to secure the ridge beams together.

It will be obvious to those reasonably skilled in the art that a single ridge beam may be used to support roof assembly 80, or any combination of ridge beams may be used, as required by the specification and wall placement of the house. Further, the ends of the ridge beams may be cut at any angle to accommodate the shape of the roof.

Once ridge beam 50 and 90 are properly positioned on their appropriate walls, roof panels 10 are secured to the ridge beams. In FIG. 3B, a pair of roof panels 10 are attached to ridge beam 50. The bottom sheets 14 of each roof panel 10 are placed adjacent the side sheet 54 of ridge beam 50 so that their respective attachment ledges 26 rest adjacent support ledges 56 of ridge beam 50. Once in position, fasteners, such as staples, nails or screws are inserted through attachment ledges 26. Access to the proximity of ledges 26 provided through the interior of ridge beam 50. When properly secured, ends 10A roof panels 10 are vertically aligned with their insulation 20 in close proximity. Any air gap between the insulation 20 of the respective panels is filled with loose or batt insulation of a similar type. The top sheets 12 of each roof panel do not come in contact with each other and form a vault seam through which air gaps 24 may communicate with the roof exterior.

A ridge vent 68 is secured to the vault formed by the ends 10A of roof panels 10. Ridge vent 68 comprises an inverted, V-shaped member, typically plastic or metal, suspended above the top sheets 12 of the respective roof panels. Ridge vent 68 extends along the seam of the roof vault and substantially prevents water from permeating the vault seam while allowing the air gaps 24 to communicate with the exterior environment.

Figure 4B:
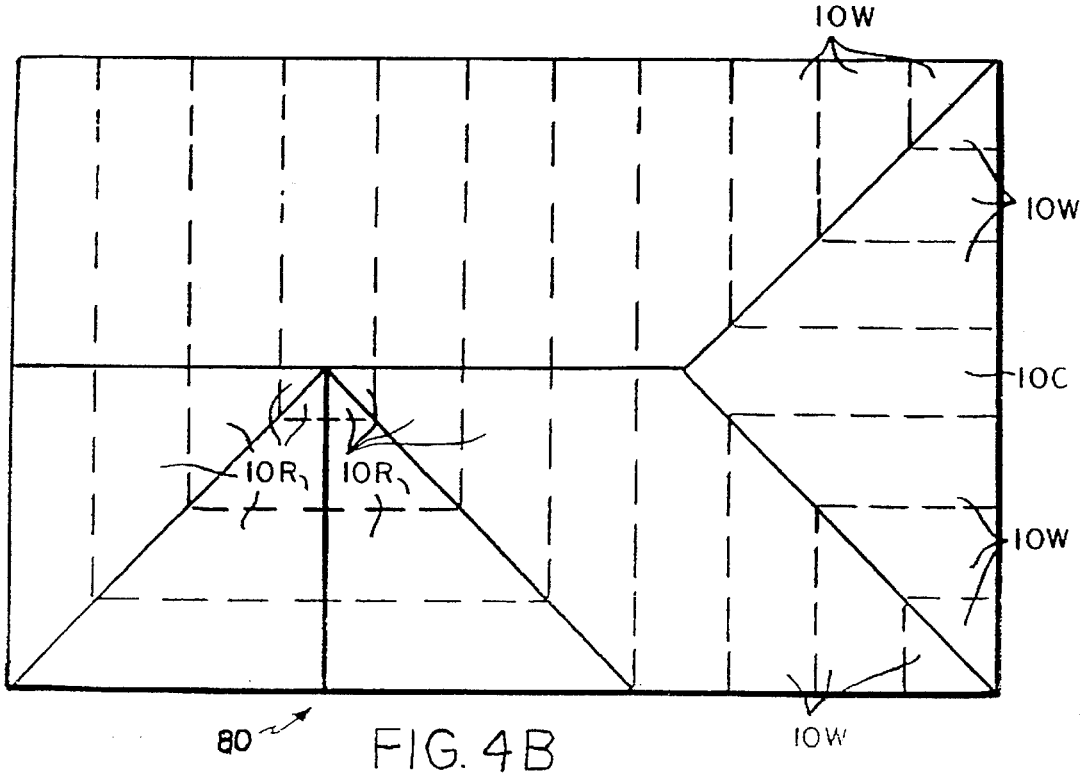
FIG. 4B is a top view of the exemplary roof assembly of FIG. 4A in its completed state showing the shape and configuration of the roof panels.

Roof panels 10 are manufactured to have complementary shapes. That is, the perimeter shape an angle and 10A of each roof panel 10 forms an angle joint with the surrounding roof panels which collectively define the vault, gable and hip sections of the roof assembly. Typically, a roof panel 10 is twisted into position and coupled with its respective ridge beam. If the opposite ends of the panel 10B is to be attached to a wall, the wall is plumbed or checked for vertical alignment and the panel then attached to the wall. The roof panel is then secured with a spline to adjacent roof panel, in a manner previously described. Each roof panel 10 or roof assembly 80 is attached to an adjacent roof panel and either a ridge beam or a wall. In this manner, each roof panel must have at least two support elements. Referring to FIG. 4B, roof panels 10W are attached to their adjacent roof panels and to their respective walls. Roof panels 10R are attached to their adjacent roof panels and to their respective ridge beams. The remainder of the roof panels 10 of roor assembly 80 are coupled to their respective ridge beam and to their respective walls as well as their adjacent panels. As indicated previously, the angled ends 10A of panels are not connected across the seams of the roof. It may be appreciated, therefore, that splines 40 which interconnect adjacent roof panels 10 provide a major support function for various sections of the roof assembly 80. In FIG. 4B, panel 10C is secured to the end of ridge beam 50 in a manner similar to that described above except that the panel is secured to an angled, triangular end piece of ridge beam 50 which contains a support ledge 56.

Figure 5:
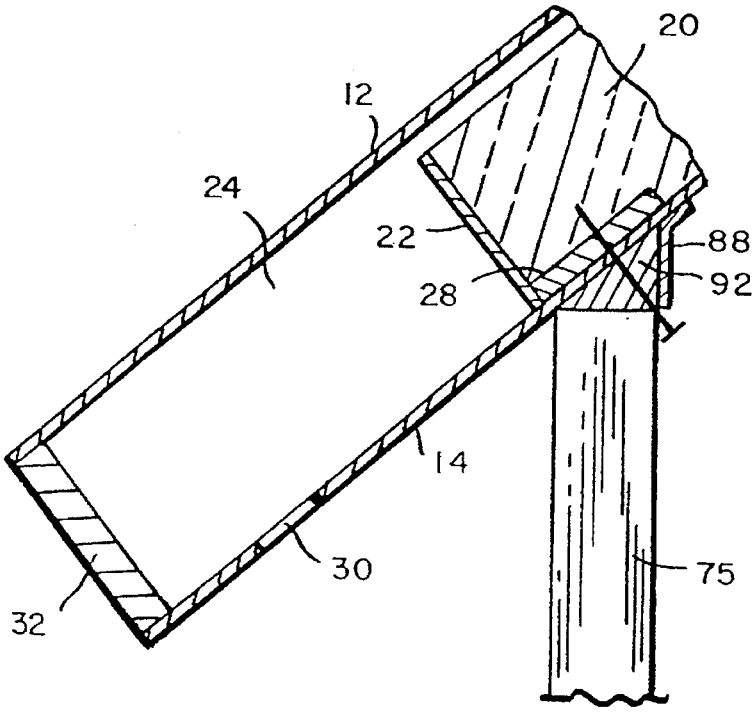
FIG. 5 is a side, cross-sectional view of the roof panel of FIGS. 1A–C and the mechanism for coupling the roof panel to a wall of the structure.

The junction of a roof panel 10 with a wall is illustrated in FIG. 5. Bottom sheet 14 of roof panel 10 rests against the edge of the wall, which for purposes of illustration will be designated as wall 75. The end of 10B of roof panel 10 overhangs wall 75 in the range of 040 to 3', typically two feet, as measured along the horizontal axis. A top plate 92, having a triangular cross-section and comprising material similar to that of reinforcement members 66 of ridge beam 50, is disposed intermediate bottom sheet 14 and the top of wall 75, as illustrated. Panel 10 is secured to the wall 75 with a fastener, typically screws, staples or anils which are driven through top plate 92 and into reinforcement strip 28 of roof panel 10. Alternately, the fastener may comprise a lite guage metal plate stapled at the intersection of the panel and the wall. It will be obvious to those reasonably skilled in the art that the cross-sectional shape of top plate 92 will vary according to the angle at which roof panel 10 is positioned in relationship to wall 75A. A molding 88 is disposed over the seam formed by bottom sheet 14 and top plate 92.

A nailer 32 is fixed across the end of roof panel 10 to facilitate attachment of trim. Nailer 32 typically is a 2×10" fascia and effectively seals the non-beveled ends of roof panel 10. Nailer 32 has a length of approximately 10' and is installed after all the roof panels 10 are in position.

It will be obvious to those reasonably skilled in the art that additional modifications to roof assembly 80, particularly to the means for joining the ridge beams to the roof panels may be made without substantially affecting the performance of roof assembly 80. In particular, fasteners other than screws, nails or staples may be used. For instance, attachment ledges 26 and support ledges 56 may be replaced or modified with complimentary portions of self-locking fasteners which, upon contact, automatically interlock the roof panel with its respective ridge beam.

More specifically, attachment ledge 26 of roof panel 10 and support ledge 56 of ridge beam 50 may be replaced by a self-aligning, locking fixture mechanism. Each of the ledges may be replaced with a light guage, angled metal strip having a serrated edge, with teeth oriented in a specific direction. In this joining assembly, a first strip has a V-shaped cross-section bent at a wide angle with one leg of the strip attached flush with the surface of ridge beam 50 and extending along the length of the ridge beam. The other leg of the strip projects upward vertically and contains the serrated edge with teeth oriented in a first direction. A similar second metal strip is secured to the bottom sheet 14 of a roof panel 10, with one leg of fastened flush with the bottom sheet and the other leg projecting substantially horizontally. The horizontally projecting leg of the second strip contains an edge of serated teeth which are oriented in a second direction. As the roof panel 10 is positioned on ridge beam 50, the ramped portion of the serrated edges slide over one another allowing the roof panel 10 to be properly positioned. However, motion in the opposite direction is prevented by the engagement of the serated teeth. The metal strips further collapse under the weight of the roof panel when finally positioned on edge beam 50 and thereby do not create a cavity between the ridge beam and the roof panel.

It will be obvious to those skilled in the art that other types of self-aligning, gravity locking attachment configurations are suitable for use in joining roof panels 10 with the ridge beam 50.

It may be further appreciated that the shapes of roof panels 10 and ridge beam 50 may be varied to accommodate a roof having any number of hip sections, gables, or vaults, without departing from the disclosed roof panel and ridge beam designs. In this manner, the roof assembly 80 is not limited to the embodiment described above with respect to the structure illustrated in 4A–4B. The components of roof assembly 80 may be custom manufactured and assembled into any pitched roof design, as explained hereinafter.

Method for Custom Engineered Roof Assembly

Figure 6:
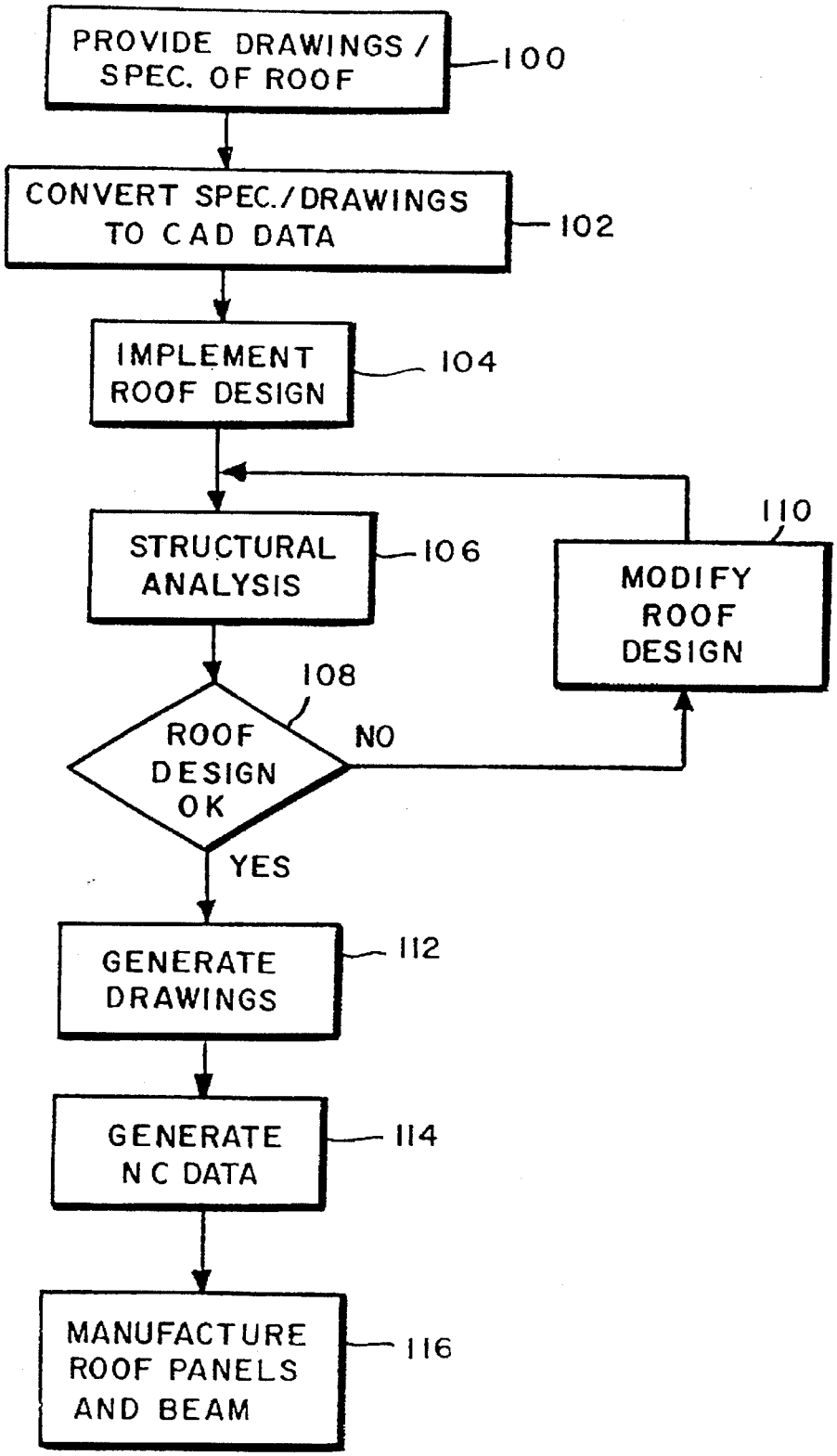
FIG. 6 is a flow chart illustrating the steps of a method of engineering a roof assembly in accordance with the present invention.

Referring to FIG. 6, a flow chart illustrating the steps of a method of engineering and manufacturing a roof assembly, according to a fourth aspect of the invention, is illustrated. The method of the present invention transforms an architectural drawing or specification for a roof design into an assembly of roof panels, ridge beams and fastening elements in a way which will minimize both the time and cost of manufacturing and assembly.

Referring to FIG. 6, an architectural drawing or hand drawing of the desired roof design is provided to a system designer, along with a specification of the roof design, as indicated in process step 100. The specification typically includes information such as minimum and maximum design loads, constraints on the roof/wall interfaces, desired thermal and acousticcharacteristics of the roof, etc. The designing the roof, typically an engineer or architect or other skilled person in construction technology, converts the drawings and specifications into computer aided design (CAD) data using a commercially available or proprietary CAD software package, running on a computer system, as indicated in process step 102. Alternately, if the specification for the desired roof design as well as the architectural drawings are already available in a CAD file, steps 100 and 102 may be eliminated, and the CAD data merely transferred to the computer system used by the designer.

Next, the designer will create a computer model of the roof as it would be implemented using the roof panel design and ridge beam design of the present invention, as indicated in step 104. Typically, computer models of the shape and characteristics of the roof panel and ridge beam are stored in computer memory and these models used to calculate the exact number, shape and placement of the roof panels and ridge beams, necessary to implement the desired roof design.

The designer then performs a structural analysis on the resulting computer model, as indicated in step 106 of FIG. 6. The structural analysis is performed with the CAD software package, the scope of the analysis being dependent on the sophistication of the CAD package utilized. At a minimum, a structural analysis must be performed to verify that the computer generated model of the roof meets all the design load requirements and constraints on the interface of the roof with the walls of the structure. A more sophisticated structural analysis would include an analysis of the thermal characteristics of the roof including heat conduction, possible thermal bridging, and even cross-ventilation through the roof, for given types and configurations of insulation within the roof panels. The structural analysis may further include an analysis of the acoustic properties of the roof, particularly the ability of the roof to attenuate various frequencies of sound, given a particular type and configuration of insulation within the roof panels and spline structure between adjacent roof panels. The structural analysis may also include a cost estimate and analysis based on the projected materials and labor costs for the manufacture and assembly of the computer generated design model.

The results of the various aspects of the structural analysis are then compared with the specification for the roof design, as indicated by decisional step 108. If the characteristics of the computer-generated design model meet all the requirements of the roof specification, the design is verified. However, if one or more requirements of the roof specification are not met by the computer generated model, the designer interactively modified the design, as indicated in process step 110. Typically, modifications of the design will include changing the number, configuration, or individual shapes of the roof panels. In addition, the design of the panel may be changed, including the thickness, type of insulation, width, etc. Such modifications may further include modifications to the length of the ridge beam, or the angle at which the ridge beam ends are cut. In some instances, proposed modifications to the walls, columns, or other support elements of the structure may be made to adequately support the roof design. Once modifications are made to the design, steps 106 and 108 are repeated until the computer-generated design meets all the requirements of the roof specification.

Once the roof design is verified, the computer generated model of the roof is used to generate information necessary for the production and assembly of the individual components of the roof assembly. In particular, production and assembly drawings, part lists, packaging instructions and exact cost evaluation are generated from the computer model of the roof design, as indicated in process step 112. In addition, the CAD data representing the computer generated the model used to generate numerical control (NC) data used for driving production machinery to manufacture the components of the roof, as indicated in process step 114.

Next, the numerical control data generated in step 114 is used to drive production machinery which manufactures the roof panels, ridge beam and other components of the roof assembly, as indicated in process step 116. For the manufacturing of roof panels, the numerical control data is used to control a cutting machine, assembly machine and insulation machine, as explained hereinafter.

It may be appreciated from the foregoing explanation that the present invention provides a method for transforming an architectural drawing or specification of a roof design into custom engineered components for a roof assembly. It will be further obvious that once steps 100 through 114 have been executed that any number of identical roof assemblies may be manufactured using the same data by simply repeating step 116, i.e. the manufacturing of the components.

Figure 7:
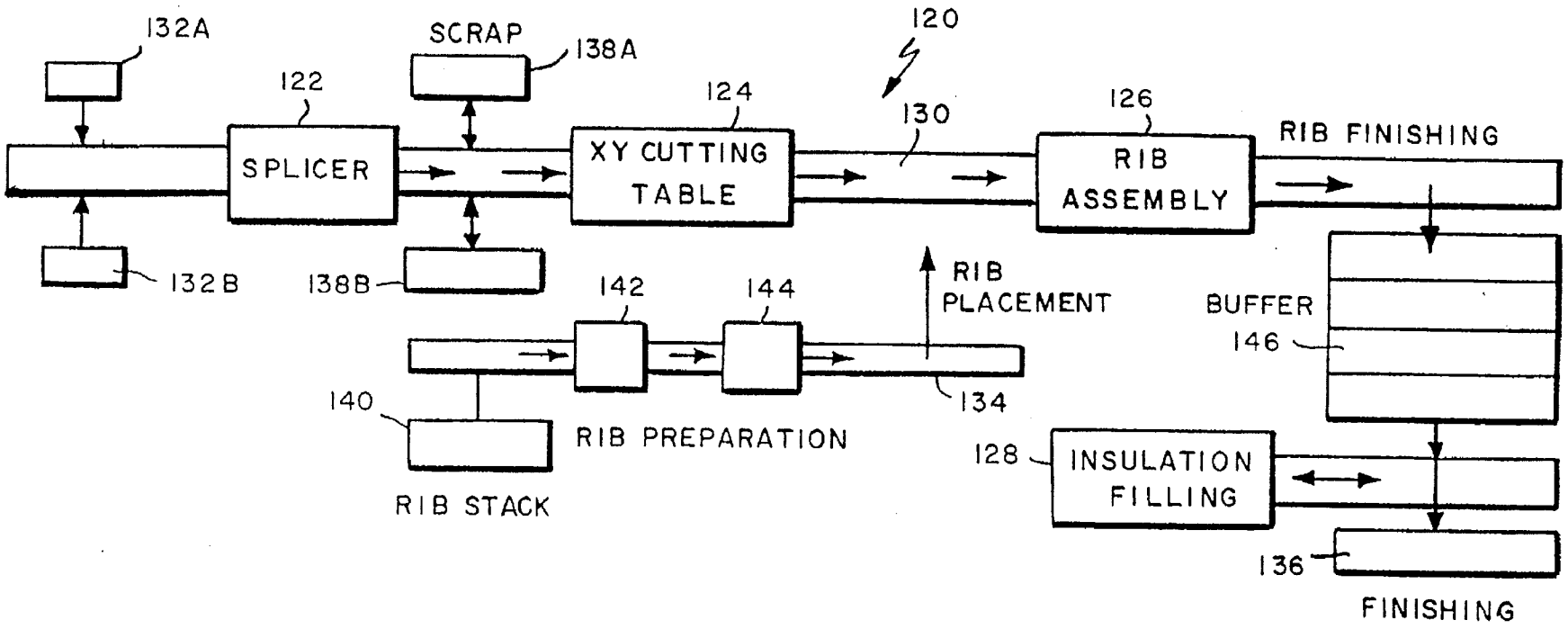
FIG. 7 is a block diagram of the manufacturing assembly line for manufacturing the roof panel in accordance with the present invention.

Referring to FIG. 7, a manufacturing assembly for use in manufacturing roof panels, in accordance with a fifth aspect of the present invention is illustrated. Assembly line 120 comprises a splicer 122, X-Y cutting table 124, rib assembly machine 126, insulation filling machine 128, and conveyor line 130. The machines of assembly line 120 are typically placed in series with material transfer between them over conveyor line 130. The total length of assembly line 120 will typically be up to approximately 250 feet and may be folded to occupy less space.

The primary raw material for the roof panels will be stock size panels of OSB and/or gypsum fiberboard, typically 4×16 feet. The standard stock panels are spliced together to both minimize waste and to accommodate roof panels which may have a length greater than the length of the stock panels. As indicated in FIG. 7, two supply stacks, 132A–B supply stock panels to conveyor line 130 for transport to splicer 122. Supply stack 132A supplies panels to be used for the top sheet of the roof panel. Stack 132B supplies panels to be used for the bottom sheet of the roof panel. Conveyor line 130 transports the panels to splicer 122 which splices sequential panels of the same composition. Typically, the stock panels contain joining facilities such as beveled edges or finger joints. Splicer 122 secures the panels together with a wood glue such as PRF adhesive.

Once the stock panels are spliced together they are transported via conveyor line 130 to X-Y cutting table 124. Cutting table 124 is driven by NC data supplied to it by the assembly line control processor (not shown). The cutting tool used in cutting table 124 may be a water jet or a conventional router for inside cuts and a circular saw for external, straight cuts. Each panel is cut to size, including openings and angle cuts, one at a time. The top sheet and bottom sheets of the roof panel are cut separately to accommodate the eventual differences at the angle joint ends. Any scrap resulting from the cutting process is transferred to scrap bins 138A-B.

The following cutting, the top and bottom sheets of the roof panel, are supplied, along with the panel ribs, to rib assembly 126. The primary ribs at this point have been prepared in a process similar to that of the top and bottom sheets. In particular, stock ribs of a standard length and width are removed from a stack 140 onto a rib conveyor 134 where they are transported to a rib splicer 142 for splicing. The spliced ribs are then transported to a rib cutter 144 which cuts the ribs to an appropriate length under the control of the system processor. The cut ribs and then transferred from rib conveyor line 134 to conveyor line 130 for transport to rib assembler 126. The ribs may be transferred from rib conveyor line 134 to conveyor line 130 manually or with automatic transfer devices.

Rib assembler 126 is a dedicated machine which positions and secures the ribs intermediate the top and bottom sheets of the roof panel. In the illustrative roof panel, the ribs are secured to the top and bottom sheets with PRF adhesive. Accordingly, rib assembler 126 will perform the function of positioning and depositing the adhesive on the appropriate surfaces, and applying pressure where necessary. Alternately, rib assembly 126 can be designed to secure the ribs to the top and bottom sheet using coil nails, metal fasteners or wood gussets.

Following assembly, the roof panel is transported, via conveyor line 130, to a buffer area 148. The roof panel is then supplied to an insulation filling machine 128. Insulation filling machine 128 deposits insulation into the cavities formed between the ribs and top and bottom sheets of the roof panel. In one embodiment, insulation filling machine 128 is designed to blow loose glass or cellulose fibers, mixed with a bonding agent to add rigidity, into the cavities of the roof panel. In another embodiment, insulation filling machine 128 deposits fiberglass bat insulation, typically cut from rolls, into the cavities. In an embodiment where foam insulation is used in the roof panels, insulation filling machine 128 will cut and insert the foam into the appropriate location in the roof panel.

Once the panels have been insulated, they proceed via conveyor line 130, to finishing machine 136 to receive interior and exterior coatings, as appropriate. Finally, several manual operations are performed on the roof panel such a minor trimming, attachment of fasteners and/of joining devices such as the attachment ledge, and packaging of the roof panel.

The speed of assembly line 120 will vary depending on the specific implementation. Where materials are handled manually, the speed of the line will be limited to approximately 20 feet per minute. Where the assembly line is automated, the speed of the line will be limited typically by insulation machine 128 to approximately 40 feet per minute.

The assembly line 120 described above is capable of manufacturing panels which have a standard design with variable perameters. In particular, the roof panels are typically produced in one or two standard widths, typically two or four feet. However, non-standard widths in the range of 0.5 to 4 feet can be obtained from standard panels after the panels are cut and the ribs assembled therein. Panels having 8 foot widths can be produced on similar equipment suitably adapted. However, the weight of such a panel becomes a factor in the transportation and placement of the panel on the structure. The roof panels may be manufactured to have any length up to a maximum limitation of the assembly line, e.g. 25 feet. The thickness of the top and bottom sheets of the roof panel may vary up to approximately 1". Similarly, the height of the panel, i.e. the distance between the ribs, may vary from 8" to 14". Other modifications to the various components of the roof panel will become apparant to those reasonably skilled in the art and may be implemented without deviating from the standard panel design described herein.

It may be further appreciated from the foregoing that the assembly line 130 provides reasonable flexibility in the manufacturing of the roof panel. Modifications to the assembly line 120 and its component production machinery may be made as necessary to accommodate different roof panel specifications, for instance wood veneers applied to the bottom sheet of the roof panel.

Having thus described particular embodiments in accordance with the present invention, various alterations, modifications and improvements will readily occur to those skilled in the art. Such alterations, modifications and improvements as are made obvious by this disclosure are intended to be part of this disclosure although not expressly stated herein, and are intended to be within the spirit and scope of the invention. Accordingly, the foregoing description is intended to be exemplary only and not limiting. The invention is limited only as defined in the following claims and equivalents thereto.

What is claimed is:

1. A roof panel, comprising first and second sheets, disposed substantially parallel to each other along a first plane; and a plurality of primary ribs extending along a second plane normal to the first plane, each of the primary ribs attached to the first and second sheets and defining at least one cavity between the sheets, wherein the primary ribs are adapted to pass air between adjacent cavities: and a plurality of secondary ribs each of the secondary ribs attached to at least one of the sheets and one of the primary ribs.

2. The roof panel of claim 2, further comprising means for coupling the first sheet to a surface.

3. The roof panel of claim 2, wherein at least one of the plurality of primary ribs includes a vent hole.

4. The roof panel of claim 3, wherein the vent hole of the at least one of the plurality of primary ribs is located adjacent an interior of the first sheet.

5. The roof panel of claim 2, wherein the second sheet includes at least one vent hole.

6. The roof panel of claim 5, wherein the at least one vent hole of the second sheet extends in a direction perpendicular to the first and second planes.

7. The roof panel of claim 5, wherein at least one of the plurality of primary ribs includes a vent hole.

8. A roof panel, comprising first and second sheets, disposed substantially parallel to each other along a first plane; and a plurality of primary ribs extending along a second plane normal to the first plane, each of the primary ribs attached to the first and second sheets and defining at least one cavity between the sheets, wherein the primary ribs are adapted to pass air between adjacent cavities, and wherein insulation is disposed adjacent the first sheet and is separated from the second sheet by a gap of air.

9. A roof panel, comprising first and second sheets, disposed substantially parallel to each other along a first plane; and a plurality of primary ribs extending along a second plane normal to the first plane, each of the primary ribs attached to the first and second sheets and defining at least one cavity between the sheets, wherein the primary ribs are adapted to pass air between adjacent cavities, and wherein at least one of the plurality of primary ribs is formed from a porous material.

10. A roof panel comprising:

first and second sheets disposed substantially parallel to each other along a first plane;

a plurality of primary ribs extending along a second plane normal to the first plane, each of the primary ribs attached to the first and second sheets and defining at least one cavity between the sheets, the first and second sheets and one of the plurality of ribs collectively defining a recess along a perimeter of the roof panel for receiving a spline element; and a spline element adapted to be received into a cavity formed by the recesses of two adjacent roof panels, the spline element being partially disposed along the perimeter of the roof panel, wherein the spline element comprises:

a core; and a plurality of gussets.

11. The roof panel of claim 10, wherein the core is formed from foam.

12. The roof panel of claim 10, wherein at least one of the plurality of gussets is formed from foam.

13. The roof panel of claim 10, wherein the core has at least one vent hole.

14. The roof panel of claim 13, wherein the at least one vent hole of the core is aligned with the vent hole of the at least one of the plurality of primary ribs.

15. The roof panel of claim 10, wherein at least one of the plurality of primary ribs includes a vent hole.

16. The roof panel of claim 15, wherein vent hole of the core is aligned with the vent hole of the at least one of the plurality of primary ribs.

* * * * *